US008758044B2

(12) United States Patent
Tseng et al.

(10) Patent No.: US 8,758,044 B2
(45) **Date of Patent: *Jun. 24, 2014**

(54) ELECTRICAL CONNECTOR ASSEMBLY HAVING A PRINTED CIRCUIT BOARD WITH SOLDERING HOLES INTERCONNECTED TO A PLURALITY OF TERMINALS AND A FLAT FLEXIBLE CABLE

(71) Applicant: Bing Xu Precision Co., Ltd., New Taipei (TW)

(72) Inventors: Ting-Chang Tseng, New Taipei (TW); Wen-Lung Lin, New Taipei (TW)

(73) Assignee: Bing Xu Precision Co., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/947,942

(22) Filed: Jul. 22, 2013

(65) Prior Publication Data

US 2013/0303018 A1 Nov. 14, 2013

Related U.S. Application Data

(63) Continuation of application No. 13/422,053, filed on Mar. 16, 2012, now Pat. No. 8,512,071.

(51) Int. Cl.
*H01R 12/24* (2006.01)

(52) U.S. Cl.
USPC ..... 439/493

(58) Field of Classification Search
USPC ..... 439/492–499, 564, 604, 77
See application file for complete search history.

(56) References Cited

U.S. PATENT DOCUMENTS

| | | | | |
|---|---|---|---|---|
| 6,368,155 | B1 * | 4/2002 | Bassler et al. | 439/620.21 |
| 6,695,641 | B1 * | 2/2004 | Lee | 439/493 |
| 6,848,950 | B2 * | 2/2005 | Allison et al. | 439/682 |
| 6,866,538 | B2 * | 3/2005 | Lee | 439/404 |
| 7,938,668 | B2 * | 5/2011 | Chen et al. | 439/351 |
| 8,007,324 | B2 * | 8/2011 | Wang et al. | 439/660 |
| 8,512,071 | B2 * | 8/2013 | Tseng et al. | 439/493 |
| 2011/0136365 | A1 * | 6/2011 | Hara | 439/329 |

* cited by examiner

*Primary Examiner* — Chandrika Prasad

(57) ABSTRACT

A SATA connector assembly is provided with an insulating housing, a plurality of data and power terminals, a PCB and an FFC, wherein the data and power terminals inserted in the insulating housing, the PCB secured to the insulating housing, the FFC soldered on the PCB, the data and power terminals are electrically interconnected the FFC by the PCB. The provision of the unitary construction feature of FFC can save the production cost due to its eliminating cable management equipment and the step of cable managing processes.

20 Claims, 9 Drawing Sheets

ELECTRICAL CONNECTOR ASSEMBLY HAVING A PRINTED CIRCUIT BOARD WITH SOLDERING HOLES INTERCONNECTED TO A PLURALITY OF TERMINALS AND A FLAT FLEXIBLE CABLE

CROSS REFERENCE TO RELATED APPLICATION

This is a Continuation Application of a U.S. patent application Ser. No. 13/422,053, filed on Mar. 16, 2012.

BACKGROUND OF THE INVENTION

1. Field of the Invention

The invention relates to electrical connectors assembly and more particularly to a SATA (Serial Advanced Technology Attachment) connector assembly having a flex flat cable and a PCB (printed circuit board).

2. Description of Related Art

U.S. Pat. No. 7,815,459 entitled "Cable connector assembly having a spacer and a bracket" disclosed a cable connector assembly (e.g., SATA connector) 100 comprising an insulating housing 1 defining a base portion 10 and mating portion 11; a plurality of contacts 2 received in the insulating housing 1 and arranged in a line transversely; a cable 5 connected to the contacts 2 electrically; a cover 6 made of an insulating material and mating with the insulating housing 1. The cover 6 is attached to the base portion 10 of the insulating housing 1. The cover 6 and the mating portion 11 is located at the opposite sides of the base portion 10. A receiving space is defined by the insulating housing 1 and the cover 6. One end of the cable 6 and the contacts 2 are received and connected electrically in the receiving space. One side of the cable connector assembly comprises a hole, and the cable 5 extends out of the receiving space through the hole.

However, a number of drawbacks have been found in the '459 patent. For example, special cable management equipment and processes are particularly required to solder cable to conductors. Further, this is time consuming with low yield. Furthermore, its production cost is much high.

Not with standing the prior art, the invention is neither taught nor rendered obvious thereby.

SUMMARY OF THE INVENTION

It is therefore an object of the invention to provide an electrical connector assembly comprising an insulating housing inserting a plurality of data and power terminals, a PCB (printed circuit board) secured to the insulating housing, and an FFC (flexible flat cable), wherein the data and power terminals are electrically interconnected the FFC by the PCB.

First advantages of the invention provided by the FFC comprise greatly facilitating the manufacturing process and reducing the manufacturing cost by eliminating cable management equipment and the step of cable managing processes.

Second advantages of the invention provided by the FFC comprise a bending portion which is fastened by the insulating housing and the PCB, thus a plurality of conductors of the FFC are firmly held in place even when the FFC is pulled accidentally, thereby ensuring a secure electrical connection of the FFC and the PCB.

Third advantages of the invention comprise the provision of a cover, together with the insulating housing and the PCB, can clamp the bending portion of the FFC. Further, an injecting hole is formed on the cover so that a person may inspect whether the bending portion of the FFC is fastened or not by seeing through the hole. Moreover, adhesive may be injected into the injecting hole to fasten the FFC and the PCB, and the adhesive can protect a soldering area between the FFC and the PCB.

It is a first aspect of the invention to provide an electrical connector assembly comprising an insulating housing having a plurality of grooves, a plurality of data terminal holes, and a plurality of power terminal holes: a PCB (printed circuit board) having a plurality of first soldering holes, a plurality of second soldering holes, a plurality of first contacts electrically connected to the first soldering holes, and a plurality of second contacts electrically connected to the second soldering holes; a plurality of power terminals fastened in the grooves of the insulating housing respectively, the power terminals each having a mating portion inserted into each of the power terminal holes, and the power terminals each having a soldering portion soldered in each of the first soldering holes; a plurality of data terminals fastened in the grooves of the insulating housing respectively, the data terminals each having a mating portion inserted into each of the data terminal holes, and the data terminals each having a soldering portion soldered in each of the second soldering holes: and an FFC (flexible flat cable) having an insulating layer for enclosing a plurality of conductors; wherein exposed ends of the conductors are electrically connected to the first contacts and the second contacts.

It is a second aspect of the invention to provide an electrical connector assembly comprising an insulating housing having a plurality of grooves, a plurality of data terminal holes, and a plurality of power terminal holes; a PCB (printed circuit board) having a plurality of first soldering portions, a plurality of second soldering portions, a plurality of first contacts electrically connected to the first soldering portions, and a plurality of second contacts electrically connected to the second soldering portions; a plurality of power terminals fastened in the grooves of the insulating housing respectively, the power terminals each having a mating portion inserted into each of the power terminal holes, and the power terminals each having a bending tail soldered on each of the first soldering portions: a plurality of data terminals fastened in the grooves of the insulating housing respectively, the data terminals each having a mating portion inserted into each of the data terminal holes, and the data terminals each having a bending tail soldered on each of the second soldering portions; and an FFC (flexible flat cable) having an insulating layer for enclosing a plurality of conductors; wherein exposed ends of the conductors are electrically connected to the first contacts and the second contacts.

It is a third aspect of the invention to provide an electrical connector assembly comprising an insulating housing having a plurality of grooves, a plurality of data terminal holes, and a plurality of power terminal holes; a PCB (printed circuit board) having a plurality of first soldering holes, a plurality of second soldering holes, a plurality of first contacts electrically connected to the first soldering holes, and a plurality of second contacts electrically connected to the second soldering holes; a plurality of power terminals fastened in the grooves of the insulating housing respectively, the power terminals each having a mating portion inserted into each of the power terminal holes, and the power ter terminals each having a soldering portion soldered in each of the first soldering holes; a plurality of data terminals fastened in the grooves of the insulating housing respectively, the data terminals each having a mating portion inserted into each of the data terminal holes, and the data terminals each having a soldering portion soldered in each of the second soldering holes; and an FFC (flexible flat cable) having an insulating layer for enclosing a plurality of conductors, end of the FFC having a first bending portion and a second bending portion; and a cover secured to the insulating housing; wherein exposed ends of the conductors are electrically connected to the first contacts and the second contacts, the first bending portion is fastened by an internal wall of the insulating housing and the PCB, and the second bending portion is fastened by an internal wall of the cover and the PCB.

The above and other objects, features and advantages of the invention will become apparent from the following detailed description taken with the accompanying drawings.

DETAILED DESCRIPTION OF THE INVENTION

Figure 1:
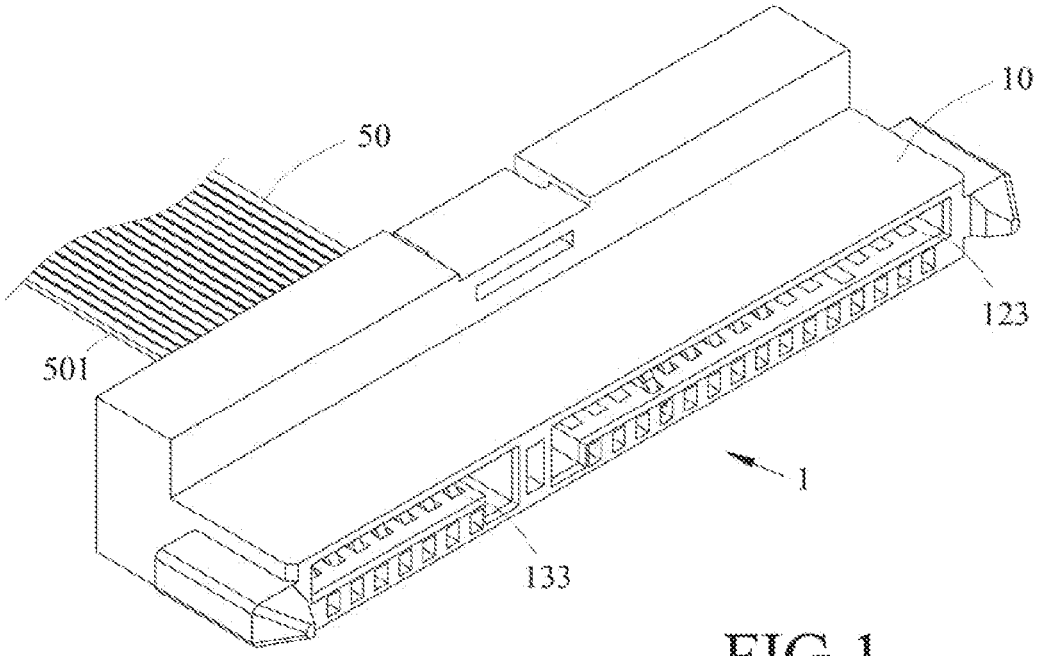
FIGS. 1 and 2 are two different perspective views of an electrical connector assembly according to a first preferred embodiment of the invention.
Figure 2:
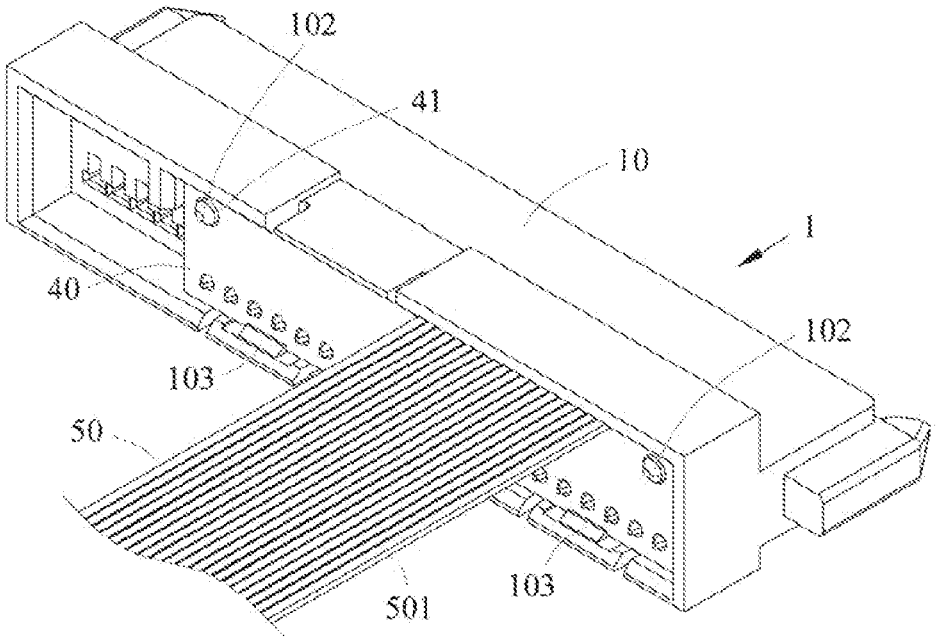
Figure 3:
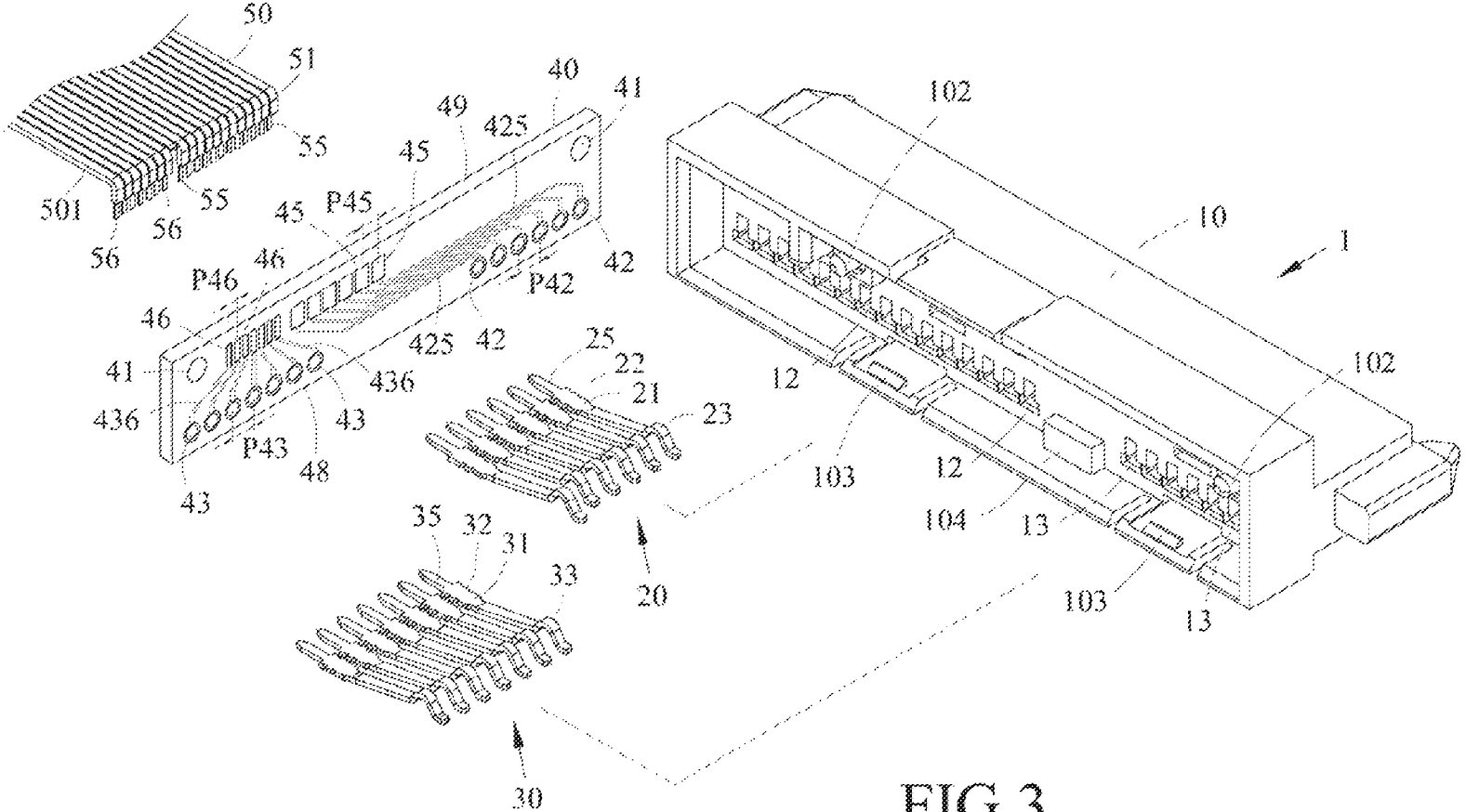
FIG. 3 is an exploded view of the electrical connector assembly of FIG. 2.

Referring to FIGS. 1 to 5, an electrical connector assembly (e.g., SATA connector) 1 in accordance with a first preferred embodiment of the invention comprises an insulating housing 10, a plurality of power terminals 20, a plurality of data terminals 30, a PCB 40, and an FFC (flex (or flexible) flat cable) 50. Each component will be discussed in detail below.

The PCB 40 is secured to the insulating housing 10. The PCB 40 comprises a plurality of first soldering holes 42, a plurality of second soldering holes 43, a plurality of first contacts 45, and a plurality of second contacts 46. A plurality of conductor paths 425 are electrically interconnected the first soldering holes 42 and the first contacts 45 respectively. A plurality of conductor paths 436 are electrically interconnected the second soldering holes 43 and the second contacts 46 respectively. The FFC 50 comprises a plurality of first conductors 55, a plurality of second conductors 56, and an insulating layer 501 for enclosing most portions of the first and second conductors 55, 56, exposed ends of the first conductors 55 electrically connected to the first contacts 45, and exposed ends of the second conductors 56 electrically connected to the second contacts 46.

Each of power terminal 20 comprises a root 21, a mating portion 23, and a soldering portion 25, each of the root 21 having a plurality of piercers 22 adapted to fasten in each of the grooves 12 of the insulating housing 10, each of the mating portion 23 inserted into one of a plurality of power terminal holes 123 of the insulating housing 10, each of the soldering portion 25 soldered in one of the first soldering holes 42.

Each of data terminal 30 comprises a root 31, a mating portion 33, and a soldering portion 35, each of the root 31 having a plurality of piercers 32 adapted to fasten in each of a plurality of the grooves 13 of the insulating housing 10, each of the mating portion 33 inserted into one of a plurality of data terminal holes 133 of the insulating housing 10, each of the soldering portion 35 soldered in one of the second soldering holes 43.

Pitch P45 between two adjacent first contacts 45 is less than pitch P42 between any two adjacent first soldering holes 42, Pitch P46 between two adjacent second contacts 46 is less than pitch P43 between any two adjacent second soldering holes 43.

Preferably, the provision of the FFC 50 can save the production cost due to its unitary construction and eliminating cable management equipment and the step of cable managing processes. This is one of the important features of the invention.

Figure 4:
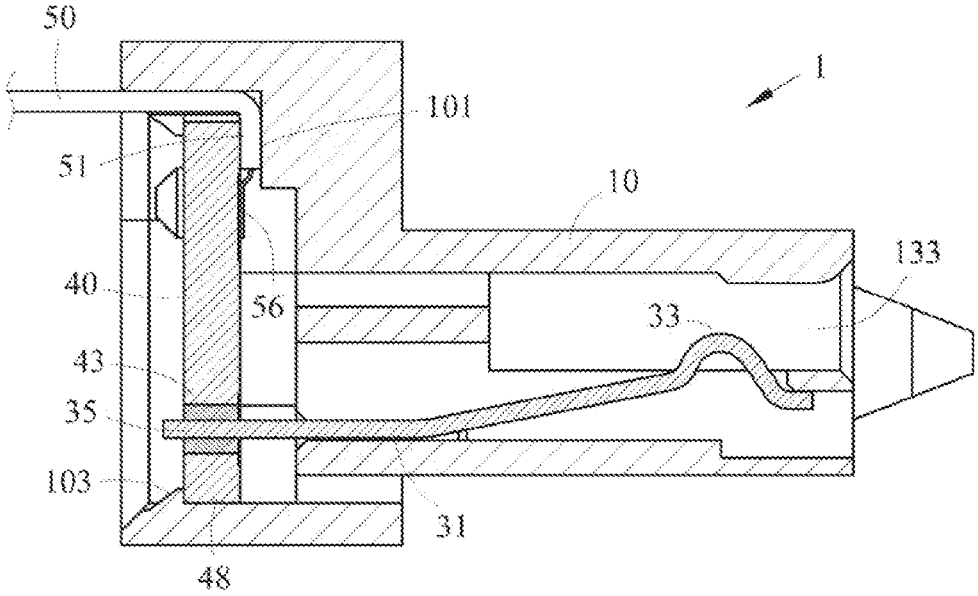
FIG. 4 is a longitudinal sectional view of FIG. 1 showing configuration of the insulating housing, the data conductors, the PCB, and the FFC.
Figure 5:
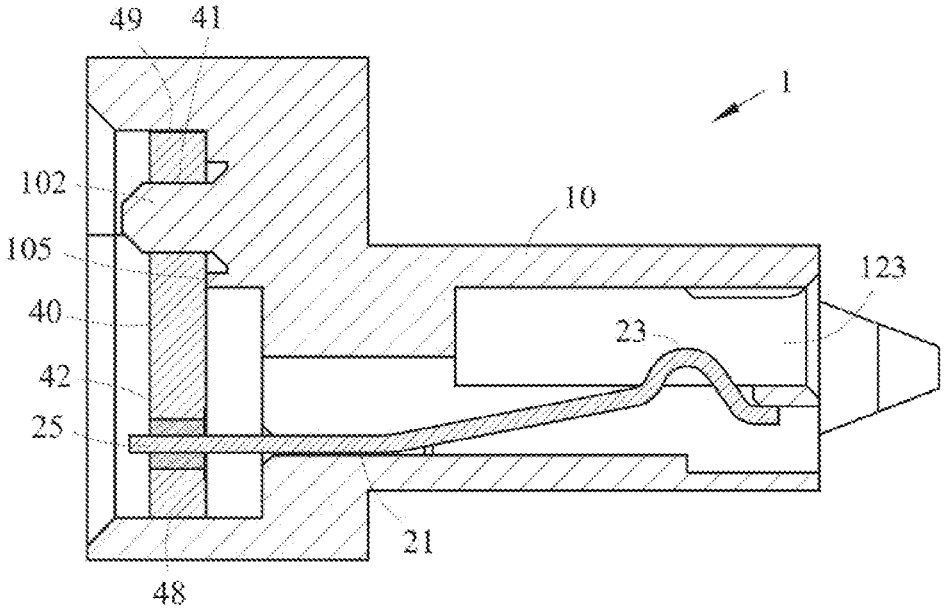
FIG. 5 is another longitudinal sectional view of FIG. 1 showing configuration of the insulating housing, the power conductors, and the PCB.

One end of the FFC 50 having a first bending portion 51 which is fastened by an internal wall 101 of the insulating housing 10 and the PCB 40 (see FIG. 4). Thus, the first and second conductors 55, 56 of the FFC 50 are firmly held in place even when the FFC 50 is pulled accidentally.

The fastening of the PCB 40 and the insulating housing 10 is detailed below. The insulating housing 10 comprises at least one pin 102 and at least one latch 103, the PCB 40 comprises at least one pin hole 41. In assembly, the pin hole 41 of the PCB 40 is securely put on the pin 102 and the latch 103 is pressed to clamp a bottom edge 48 of the PCB 40. As a result, the PCB 40 and the insulating housing 10 are fastened together (see FIGS. 4 and 5). The pin 102 of the insulating housing 10 further comprises having at least one stopper 105, the insulating housing 10 further having at least one block 104, a bottom edge 48 of the PCB 40 can be held by the latch 103 and the block 104, a top edge 49 of the PCB 40 can be held by the latch 103 and the stopper 105. As a result, the internal wall 101 of the insulating housing 10 and the PCB 40 can form a suitable gap to receive and hold the bent end 51 of the FFC 50.

The soldering of the PCB 40 and the FFC 50 is detailed below. The first conductors 55 of the FFC 50 are soldered on the first contacts 45 of the PCB 40 by a two-to-one soldering relation (a pair of first conductors 55 is soldered on a first contacts 45), the second conductors 56 of the FFC 50 are soldered on the second contacts 46 of the PCB 40 by a one-to-one soldering relation (a second conductor 56 is soldered on a second contact 46), wherein the first contacts 45 electrically connected to the first soldering holes 42 by a one-to-one connecting relation (a first contact 45 electrically connected to a first soldering hole 42 by a conductor path 425), and the second contacts 46 electrically connected to the second soldering holes 43 by a one-to-one connecting relation (a second contact 46 electrically connected to a second soldering hole 43 by a conductor path 436).

Alternatively, the soldering of the PCB 40 and the FFC 50 can be made as below. The first conductors 55 of the FFC 50 are soldered on the first contacts 45 of the PCB 40 by a one-to-one soldering relation (a first conductors 55 is soldered on a first contacts 45), the second conductors 56 of the FFC 50 are soldered on the second contacts 46 of the PCB 40 by a one-to-one soldering relation (a second conductor 56 is soldered on a second contact 46), wherein the first contacts 45 electrically connected to the first soldering holes 42 by a two-to-one connecting relation (a pair of first contacts 45 electrically connected to a first soldering hole 42 by a pair of conductor paths 425), and the second contacts 46 electrically connected to the second soldering holes 43 by a one-to-one connecting relation (a second contact 46 electrically connected to a second soldering hole 43 by a conductor path 436).

Figure 6:
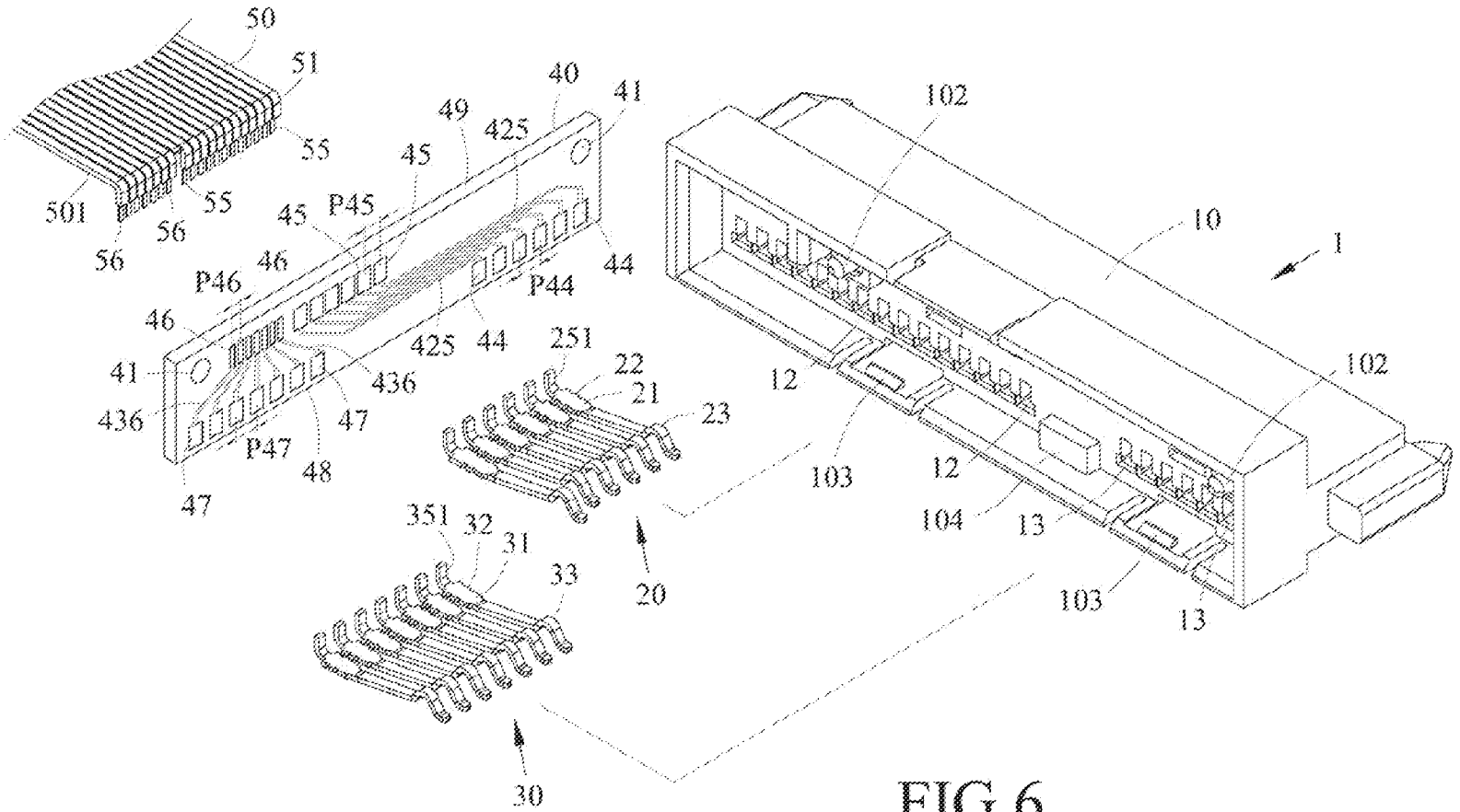
FIG. 6 is an exploded view of an electrical connector assembly according to a second preferred embodiment of the invention.
Figure 7:
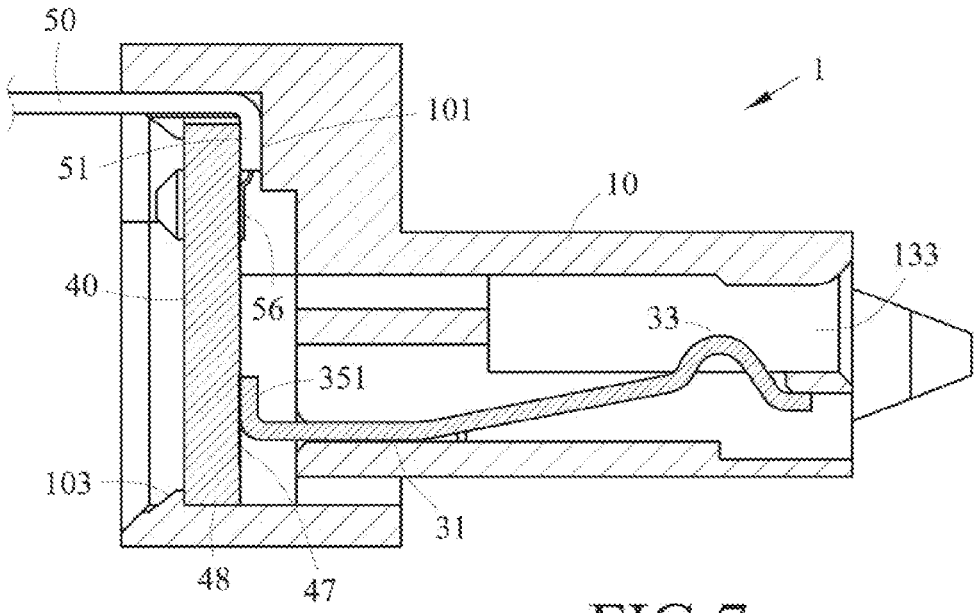
FIG. 7 is a longitudinal sectional view of the assembled electrical connector assembly of FIG. 6 showing configuration of the insulating housing, the data conductors, the PCB, and the FFC.
Figure 8:
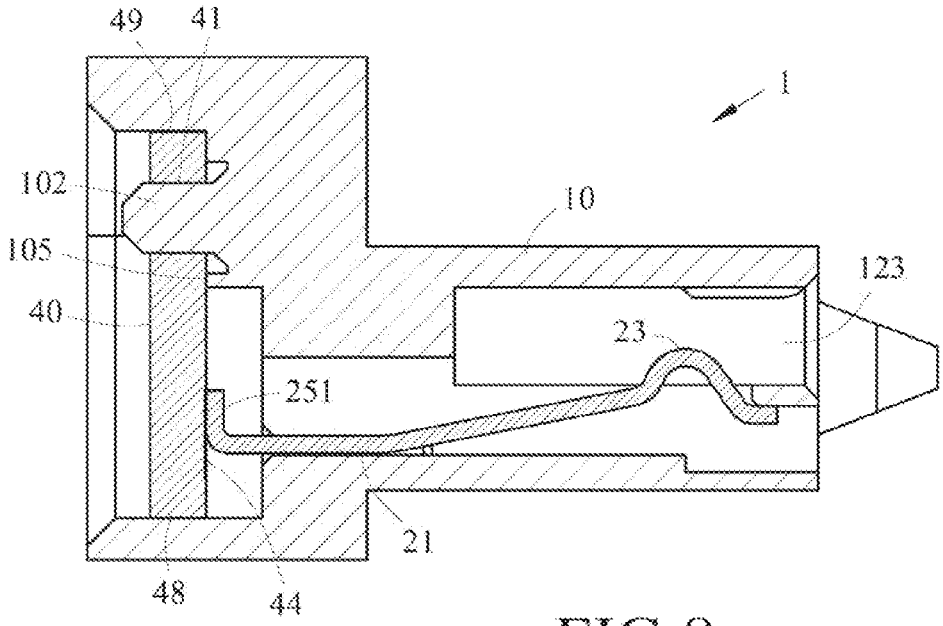
FIG. 8 is another longitudinal sectional view of the assembled electrical connector of FIG. 6 showing configuration of the insulating housing, the power conductors, and the PCB.
Figure 9:
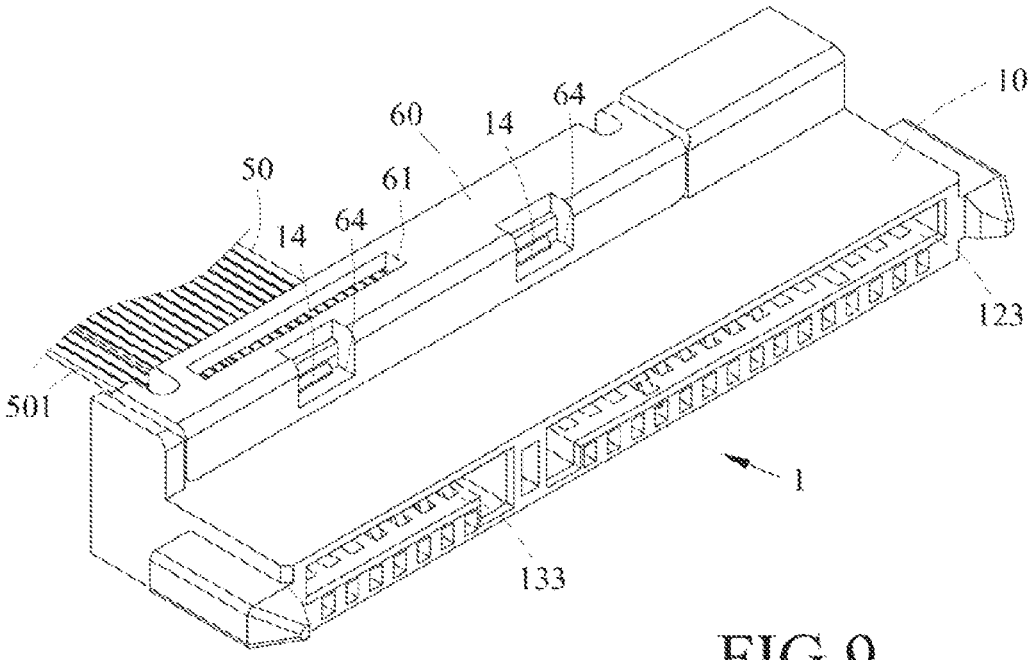
FIGS. 9 and 10 are two different perspective views of an electrical connector according to a third preferred embodiment of the invention.
Figure 10:
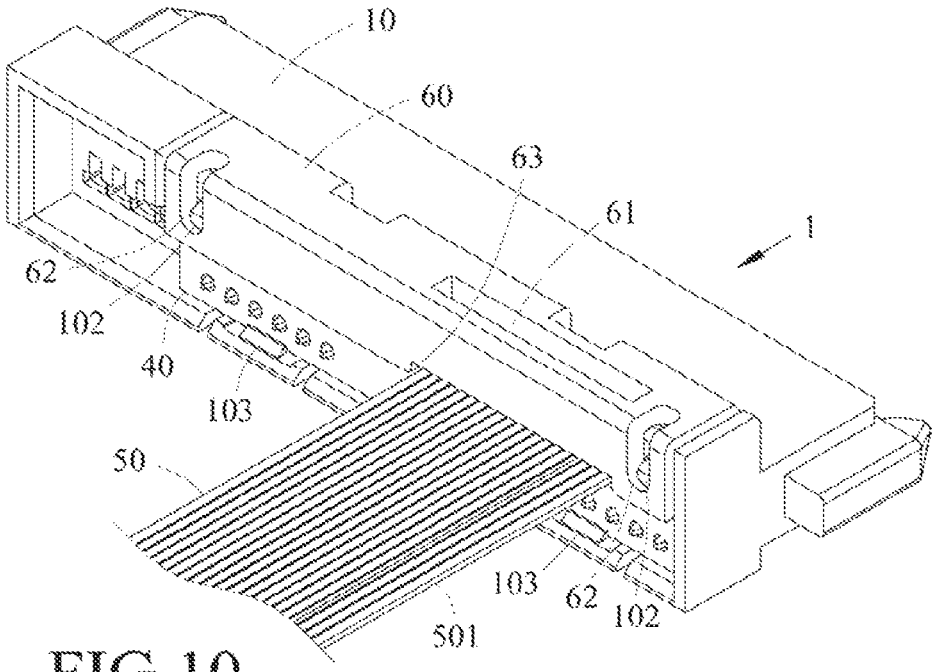
Figure 11:
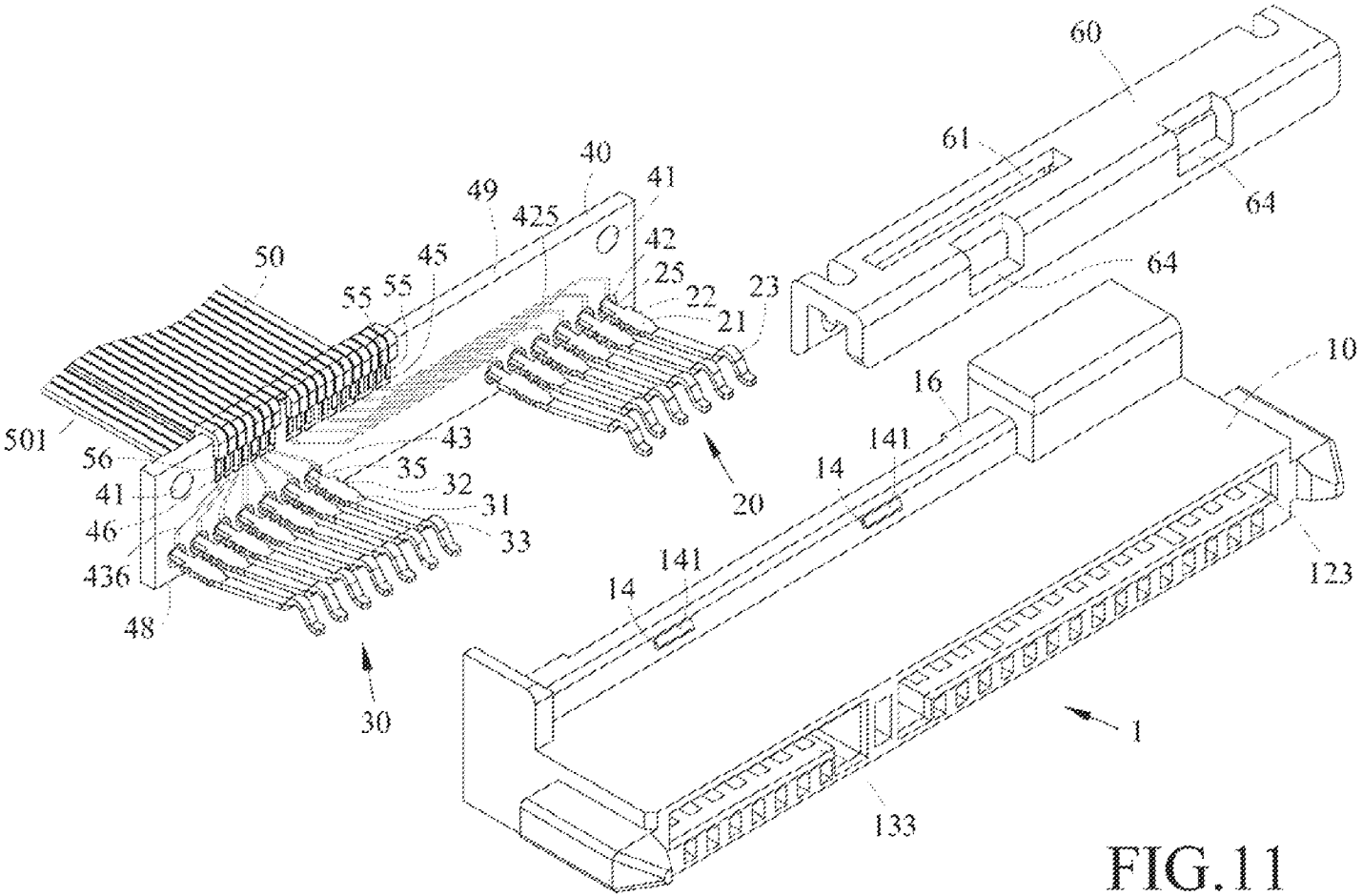
FIGS. 11 and 12 are two different exploded views of the electrical connector of FIG. 9.
Figure 12:
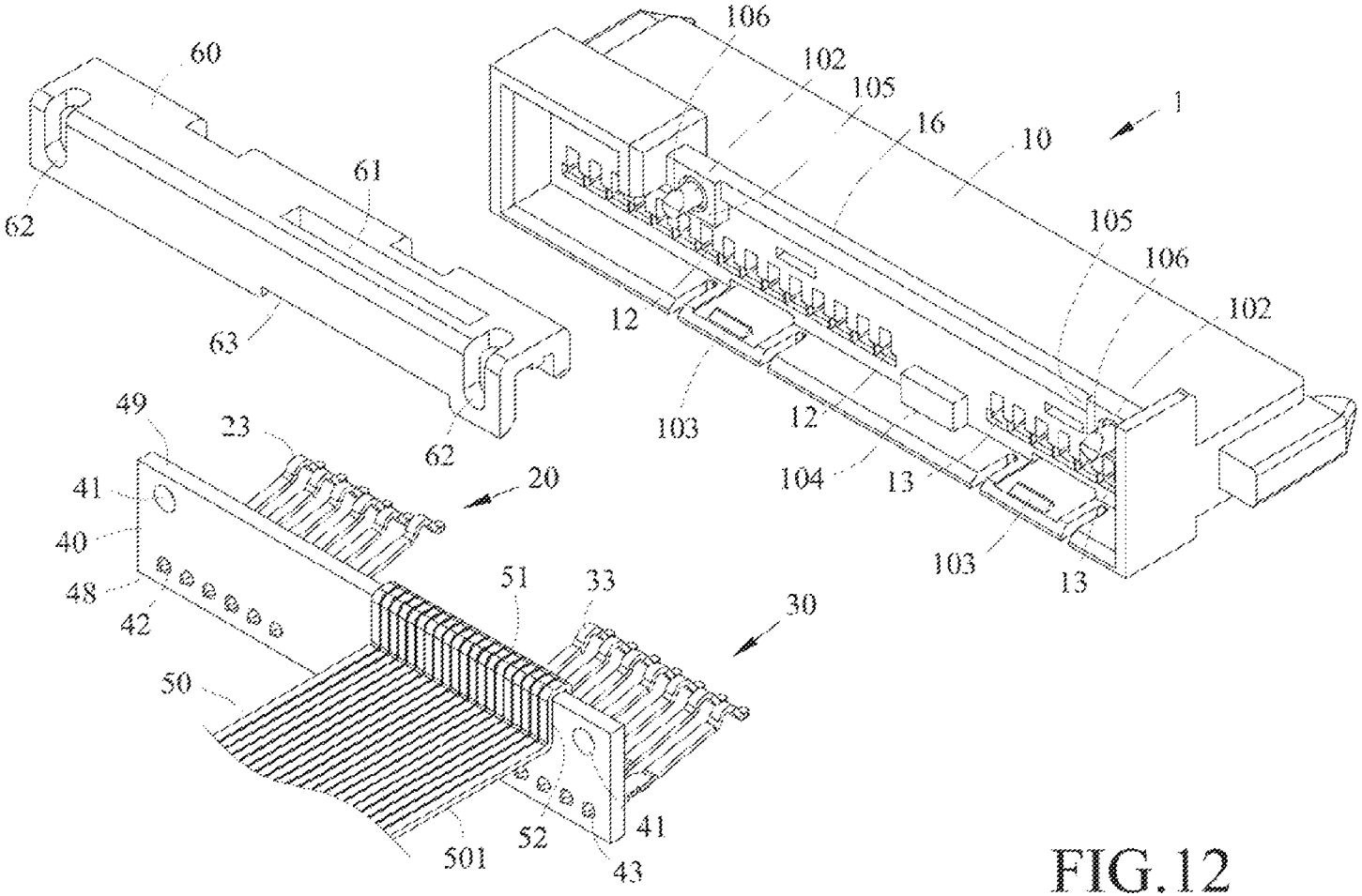
Figure 13:
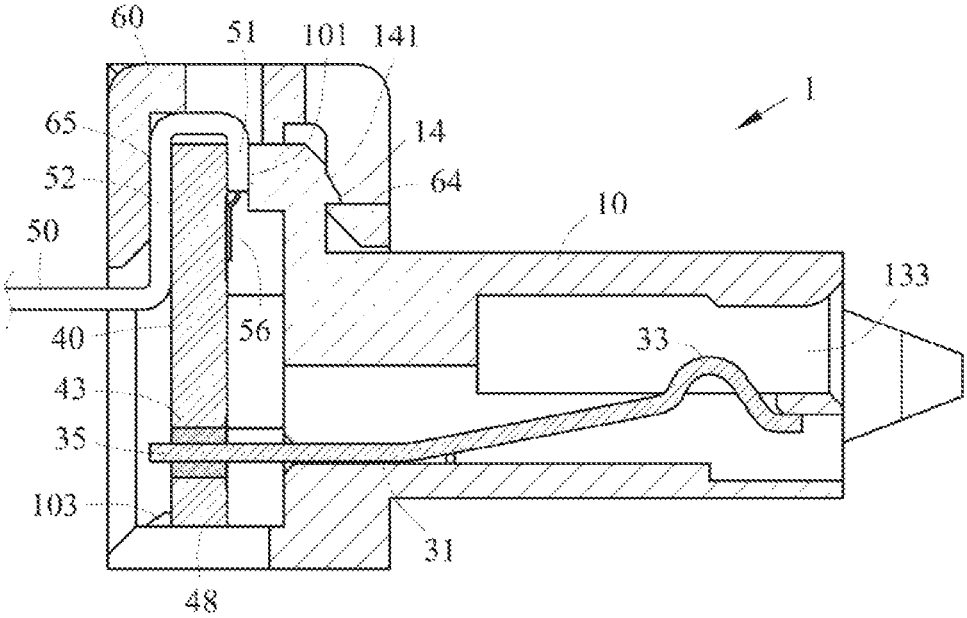
FIG. 13 is a longitudinal sectional view of FIG. 9 showing configuration of the insulating housing, the data conductors, the PCB, the FFC, and the cover.
Figure 14:
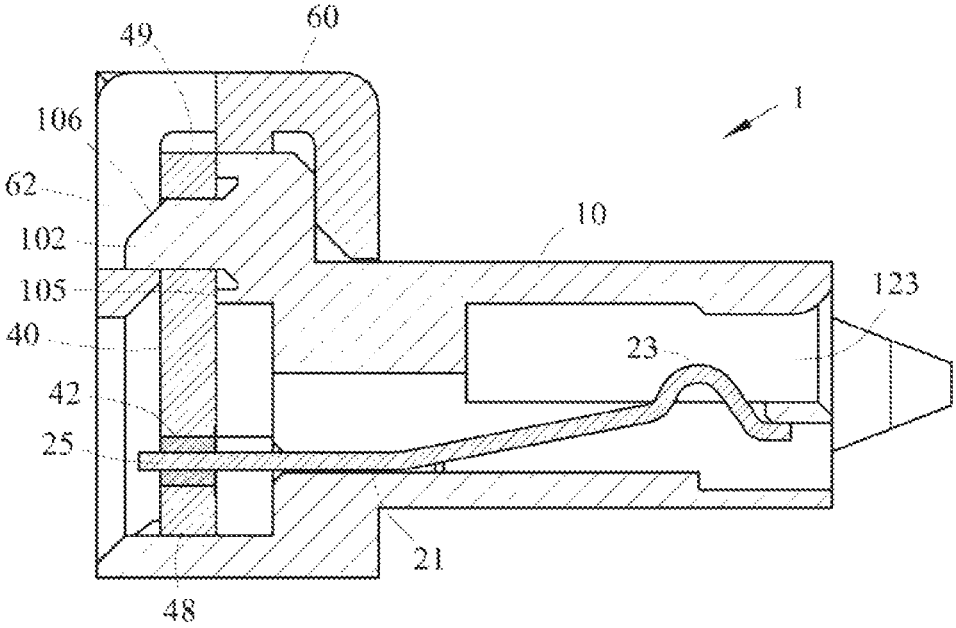
FIG. 14 is another longitudinal sectional view of FIG. 9 showing configuration of the insulating housing, the power conductors, the PCB, and the cover.

Referring to FIGS. 6 to 8, an electrical connector assembly 1 in accordance with a second preferred embodiment of the invention is shown. The characteristics of the second preferred embodiment are substantially the same as that of the first preferred embodiment except the following:

Electrical connections of the power terminals 20, the data terminals 30 and the PCB 40 are implemented as detailed below. The power terminals 20 and the data terminals 30 are replaced with terminal of SMD (Surface Mounted Device) type. The PCB 40 comprises a plurality of first soldering portions 44, a plurality of second soldering portions 47, a plurality of first contacts 45, and a plurality of second contacts 46. Each of first contacts 45 electrically connected to each of first soldering portions 44 by a conductor path 425, each of second contacts 46 electrically connected to each of second soldering portions 47 by a conductor path 436, the power terminals 20 each having a bending tail 251 soldered on each of the first soldering portions 44, and the data terminals 30 each having a bending tail 351 soldered on each of the second soldering portions 47.

Pitch P45 between two adjacent first contacts 45 is less than pitch P44 between any two adjacent first soldering portions 44. Pitch P46 between two adjacent second contacts 46 is less than pitch P47 between any two adjacent second soldering portions 47.

The soldering of the PCB 40 and the FFC 50 is detailed below. The first conductors 55 of the FFC 50 are soldered on the first contacts 45 of the PCB 40 by a two-to-one soldering relation (a pair of first conductors 55 is soldered on a first contacts 45), the second conductors 56 of the FFC 50 are soldered on the second contacts 46 of the PCB 40 by a one-to-one soldering relation (a second conductor 56 is soldered on a second contact 46), wherein the first contacts 45 electrically connected to the first soldering portions 44 by a one-to-one connecting relation (a first contact 45 electrically connected to a first soldering portion 44 by a conductor path 425), and the second contacts 46 electrically connected to the second soldering portions 47 by a one-to-one connecting relation (a second contact 46 electrically connected to a second soldering portion 47 by a conductor path 436).

Alternatively, the soldering of the PCB 40 and the FFC 50 can be made as below. The first conductors 55 of the FFC 50 are soldered on the first contacts 45 of the PCB 40 by a one-to-one soldering relation (a first conductors 55 is soldered on a first contacts 45), the second conductors 56 of the FFC 50 are soldered on the second contacts 46 of the PCB 40 by a one-to-one soldering relation (a second conductor 56 is soldered on a second contact 46), wherein the first contacts 45 electrically connected to the first soldering portions 44 by a two-to-one connecting relation (a pair of first contacts 45 electrically connected to a first soldering portion 44 by a pair of conductor paths 425), and the second contacts 46 electrically connected to the second soldering portions 47 by a one-to-one connecting relation (a second contact 46 electrically connected to a second soldering portion 47 by a conductor path 436).

Referring to FIGS. 9 to 14, an electrical connector assembly 1 in accordance with a third preferred embodiment of the invention is shown. The characteristics of the third preferred embodiment are detailed below.

The electrical connector assembly (e.g., SATA connector) 1 comprises an insulating housing 10, a plurality of power terminals 20, a plurality of data terminals 30, a PCB 40, an FFC 50, and a cover 60. Each component will be discussed in detail below.

The PCB 40 is secured to the insulating housing 10. The PCB 40 comprises a plurality of first soldering holes 42, a plurality of second soldering holes 43, a plurality of first contacts 45, and a plurality of second contacts 46. Each of first contacts 45 electrically connected to each of first soldering holes 42 by a conductor path 425, each of second contacts 46 electrically connected to each of second soldering holes 43 by a conductor path 436. The FFC 50 comprises a plurality of first conductors 55, a plurality of second conductors 56, and an insulating layer 501 for enclosing most portions of the first and second conductors 55, 56, exposed ends of the first conductors 55 electrically connected to the first contacts 45, and exposed ends of the second conductors 56 electrically connected to the second contacts 46.

Each of power terminal 20 comprises a root 21, a mating portion 23, and a soldering portion 25, each of the root 21 having a plurality of piercers 22 adapted to fasten in each of the grooves 12 of the insulating housing 10, each of the mating portion 23 inserted into one of a plurality of power terminal holes 123 of the insulating housing 10, each of the soldering portion 25 soldered in one of the first soldering holes 42.

Each of data terminal 30 comprises a root 31, a mating portion 33, and a soldering portion 35, each of the root 31 having a plurality of piercers 32 adapted to fasten in each of a plurality of the grooves 13 of the insulating housing 10, each of the mating portion 33 inserted into one of a plurality of data terminal holes 133 of the insulating housing 10, each of the soldering portion 35 soldered in one of the second soldering holes 43.

Pitch P45 between two adjacent first contacts 45 is less than pitch P42 between any two adjacent first soldering holes 42, Pitch P46 between two adjacent second contacts 46 is less than pitch P43 between any two adjacent second soldering holes 43. Preferably, the provision of the unitary construction of FFC 50 as mentioned above can save the production cost due to its eliminating cable management equipment and the step of cable managing processes.

One end of the FFC 50 having a first bending portion 51 and a second bending portion 52. The PCB 40 is secured to the insulating housing 10, the first bending portion 51 can be fastened by an internal wall 101 of the insulating housing 10 and the PCB 40. The cover 60 is buckled on a rib 16 of the insulating housing 10, the second bending portion 52 can be fastened by an internal wall 65 of the cover 60 and the PCB 40 (see FIG. 13). Thus, the first and second conductors 55, 56 of the FFC 50 are held in place even when the FFC 50 is pulled accidentally.

An injecting hole 61 is formed on the cover 60 so that a person may inspect whether the first bending portion 51 is fastened or not by seeing through the injecting hole 61. Adhesive (not shown) may be injected into the injecting hole 61 to fasten the soldered joining portions of the first conductors 55 and the first contacts 45 for protection as well as the so ldered joining portions of the second conductors 56 and the second contacts 46 for protection. The adhesive may be hot melt type adhesive, quick dry adhesive, silicone adhesive, acrylate acid based adhesive, hot melt type inorganic adhesive, AB adhesive, or UV adhesive for protecting the first bending portion 51, the first conductors 55, and the second conductors 56.

The cover 60 further comprises a indentation 63 having appropriate length and width to allow the FFC 50 to pass therethrough. This is also one of the important features of the invention.

The fastening of the cover 60, the PCB 40 and the insulating housing 10 is detailed below. The insulating housing 10 comprises at least one pin 102 and at least one latch 103, the PCB 40 comprises at least one pin hole 41. In assembly, the pin hole 41 of the PCB 40 is securely put on the pin 102 and the latch 103 is pressed to clamp a bottom edge 48 of the PCB 40 (see FIGS. 13 and 14). The cover 60 further comprises at least one buckling hole 62 and at least one buckling portion 64, the rib 16 of the insulating housing 10 comprises at least one hook 14. After the PCB 40 is secured to the insulating housing 10, the buckling hole 62 is buckled on the pin 102, and the buckling portion 64 is buckled on the hook 14, wherein the pin 102 having an inclined surface 106, and the hook 14 having an inclined surface 141. The inclined surface 106 and the inclined surface 141 will guide the cover 60 and the PCB 40 to combine with the insulating housing 10. Moreover, the pin 102 of the insulating housing 10 further comprises having at least one stopper 105, the insulating housing 10 further having at least one block 104, a bottom edge 48 of the PCB 40 can be held by the latch 103 and the block 104, a top edge 49 of the PCB 40 can be held by the latch 103 and the stopper 105. As a result, the internal wall 101 of the insulating housing 10 and the PCB 40 can form a suitable gap to receive and hold the bent end 51 of the FFC 50.

The soldering of the PCB 40 and the FFC 50 is detailed below. The first conductors 55 of the FFC 50 are soldered on the first contacts 45 of the PCB 40 by a two-to-one soldering relation (a pair of first conductors 55 is soldered on a first contacts 45), the second conductors 56 of the FFC 50 are soldered on the second contacts 46 of the PCB 40 by a one-to-one soldering relation (a second conductor 56 is soldered on a second contact 46), wherein the first contacts 45 electrically connected to the first soldering holes 42 by a one-to-one connecting relation (a first contact 45 electrically connected to a first soldering hole 42 by a conductor path 425), and the second contacts 46 electrically connected to the second soldering holes 43 by a one-to-one connecting relation (a second contact 46 electrically connected to a second soldering hole 43 by a conductor path 436).

Alternatively, the soldering of the PCB 40 and the FFC 50 can be made as below. The first conductors 55 of the FFC 50 are soldered on the first contacts 45 of the PCB 40 by a one-to-one soldering relation (a first conductors 55 is soldered on a first contacts 45), the second conductors 56 of the FFC 50 are soldered on the second contacts 46 of the PCB 40 by a one-to-one soldering relation (a second conductor 56 is soldered on a second contact 46), wherein the first contacts 45 electrically connected to the first soldering holes 42 by a two-to-one connecting relation (a pair of first contacts 45 electrically connected to a first soldering hole 42 by a pair of conductor paths 425), and the second contacts 46 electrically connected to the second soldering holes 43 by a one-to-one connecting relation (a second contact 46 electrically connected to a second soldering hole 43 by a conductor path 436).

While the invention has been described in terms of preferred embodiments, those skilled in the art will recognize that the invention can be practiced with modifications within the spirit and scope of the appended claims.

What is claimed is:

1. An electrical connector assembly comprising:

an insulating housing having a plurality of grooves, a plurality of data terminal holes, and a plurality of power terminal holes;

a PCB (printed circuit board) having a plurality of first soldering holes, a plurality of second soldering holes, a plurality of first contacts electrically connected to the first soldering holes, and a plurality of second contacts electrically connected to the second soldering holes;

a plurality of power terminals fastened in the grooves of the insulating housing respectively, the power terminals each having a mating portion inserted into each of the power terminal holes, and the power terminals each having a soldering portion soldered in each of the first soldering holes;

a plurality of data terminals fastened in the grooves of the insulating housing respectively, the data terminals each having a mating portion inserted into each of the data terminal holes, and the data terminals each having a soldering portion soldered in each of the second soldering holes; and an FFC (flexible flat cable) having an insulating layer for enclosing a plurality of conductors;

wherein exposed ends of the conductors are electrically connected to the first contacts and the second contacts.

2. The electrical connector assembly of claim 1, wherein a pitch between two adjacent first contacts is less than a pitch between any two adjacent first soldering holes of the PCB, and a pitch between any two adjacent second contacts is less than a pitch between any two adjacent second soldering holes of the PCB.

3. The electrical connector assembly of claim 1, wherein the insulating housing further comprises an internal wall, and wherein a first bending portion of the FFC is fastened by the internal wall and the PCB.

4. The electrical connector assembly of claim 1, wherein the insulating housing further has at least one latch, and the latch of the insulating housing is pressed to clamp the PCB.

5. The electrical connector assembly of claim 4, wherein the insulating housing further has at least one stopper and at least one block, wherein a bottom edge of the PCB is held by the latch and the block, a top edge of the PCB is held by the latch and the stopper.

6. The electrical connector assembly of claim 1, wherein the conductors of the FFC are soldered on the first contacts and the second conductors of the PCB by a two-to-one soldering relation, the first contacts electrically connected to the first soldering holes by a one-to-one connecting relation, and the second contacts electrically connected to the second soldering holes by a one-to-one connecting relation.

7. The electrical connector assembly of claim 1 wherein the conductors of the FFC are soldered on the contacts and the second conductors of the PCB by a one-to-one soldering relation, the first contacts electrically connected to the first soldering holes by a two-to-one connecting relation, and the second contacts electrically connected to the second soldering holes by a one-to-one connecting relation.

8. An electrical connector assembly comprising:

an insulating housing having a plurality of grooves, a plurality of data terminal holes, and a plurality of power terminal holes, a PCB (printed circuit board) having a plurality of first soldering portions, a plurality of second soldering portions, a plurality of first contacts electrically connected to the first soldering portions, and a plurality of second contacts electrically connected to the second soldering portions;

a plurality of power terminals fastened in the grooves of the insulating housing respectively, the power terminals each having a mating portion inserted into each of the power terminal holes, and the power terminals each having a bending tail soldered on each of the first soldering portions;

a plurality of data terminals fastened in the grooves of the insulating housing respectively, the data terminals each having a mating portion inserted into each of the data terminal holes, and the data terminals each having a bending tail soldered on each of the second soldering portions; and an FFC (flexible flat cable) having an insulating layer for enclosing a plurality of conductors;

wherein exposed ends of the conductors are electrically connected to the first contacts and the second contacts.

9. The electrical connector assembly of claim 8, wherein a pitch between two adjacent first contacts is less than a pitch between any two adjacent first soldering portions of the PCB, and a pitch between any two adjacent second contacts is less than a pitch between any two adjacent second soldering portions of the PCB.

10. The electrical connector assembly of claim 8, wherein the insulating housing further comprises an internal wall, and wherein a first bending portion of the FFC is fastened by the internal wall and the PCB.

11. The electrical connector assembly of claim 8, wherein the conductors of the FFC are soldered on the first contacts and the second conductors of the PCB by a two-to-one soldering relation, the first contacts electrically connected to the first soldering portions by a one-to-one connecting relation, and the second contacts electrically connected to the second soldering portions by a one-to-one connecting relation.

12. An electrical connector assembly comprising:

an insulating housing having a plurality of grooves, a plurality of data terminal holes, and a plurality of power terminal holes;

a PCB (printed circuit board) having a plurality of first soldering holes, a plurality of second soldering holes, a plurality of first contacts electrically connected to the first soldering holes, and a plurality of second contacts electrically connected to the second soldering holes;

a plurality of power terminals fastened in the grooves of the insulating housing respectively, the power terminals each having a mating portion inserted into each of the power terminal holes, and the power terminals each having a soldering portion soldered in each of the first soldering holes;

a plurality of data terminals fastened in the grooves of the insulating housing respectively, the data terminals each having a mating portion inserted into each of the data terminal holes, and the data terminals each having a soldering portion soldered in each of the second soldering holes; and an FFC (flexible flat cable) having an insulating layer for enclosing a plurality of conductors, end of the FFC having a first bending portion and a second bending portion; and a cover secured to the insulating housing;

wherein exposed ends of the conductors are electrically connected to the first contacts and the second contacts, the first bending portion is fastened by an internal wall of the insulating housing and the PCB, and the second bending portion is fastened by an internal wall of the cover and the PCB.

13. The electrical connector assembly of claim 12, wherein a pitch between two adjacent first contacts is less than a pitch between any two adjacent first soldering holes of the PCB, and a pitch between any two adjacent second contacts is less than a pitch between any two adjacent second soldering holes of the PCB.

14. The electrical connector assembly of claim 12, wherein the cover having an injecting hole for injecting adhesive thereinto, the position the injecting hole corresponded to the position of the first bending portions of the FFC, the adhesive being hot melt type adhesive, quick dry adhesive, silicone adhesive, acrylate acid based adhesive, hot melt type inorganic adhesive, AB adhesive, or UV adhesive for protecting the first bending portions and the conductors.

15. The electrical connector assembly of claim 12, wherein the cover further comprises an indentation to allow the FFC to pass therethrough.

16. The electrical connector assembly of claim 12, wherein the insulating housing further has at least one latch, the PCB further has, and the latch of the insulating housing is pressed to clamp the PCB.

17. The electrical connector assembly of claim 12, wherein the cover is buckled on a rib of the insulating housing, the cover further comprises at least one buckling hole and at least one buckling portion, the rib further comprises at least one hook, and the buckling portion is buckled on the hook, wherein the hook having an inclined surface.

18. The electrical connector assembly of claim 12, wherein the insulating housing has at least one block and at least one stopper, wherein a bottom edge of the PCB is held by the latch and the block, a top edge of the PCB is held by the latch and the stopper.

19. The electrical connector assembly of claim 12, wherein the conductors of the FFC are soldered on the first contacts and the second conductors of the PCB by a two-to-one soldering relation, the first contacts electrically connected to the first soldering holes by a one-to-one connecting relation, and the second contacts electrically connected to the second soldering holes by a one-to-one connecting relation.

20. The electrical connector assembly of claim 12, wherein the conductors of the FFC are soldered on the first contacts and the second conductors of the PCB by a one-to-one soldering relation, the first contacts electrically connected to the first soldering holes by a two-to-one connecting relation, and the second contacts electrically connected to the second soldering holes by a one-to-one connecting relation.

* * * * *